US009498001B2

(12) United States Patent
Wu

(10) Patent No.: US 9,498,001 B2
(45) Date of Patent: Nov. 22, 2016

(54) ATOMIZING DEVICE OF ELECTRONIC CIGARETTE

(71) Applicant: SHENZHEN SMACO TECHNOLOGY LIMITED, Shenzhen City, Guangdong Province (CN)

(72) Inventor: Yangyang Wu, Shenzhen (CN)

(73) Assignee: SHENZHEN SMACO TECHNOLOGY LIMITED, Shenzhen, Guangdong Province (CN)

( * ) Notice: Subject to any disclaimer, the term of this patent is extended or adjusted under 35 U.S.C. 154(b) by 93 days.

(21) Appl. No.: 14/638,988

(22) Filed: Mar. 4, 2015

(65) Prior Publication Data

US 2016/0255877 A1 Sep. 8, 2016

(51) Int. Cl.
*A61H 33/12* (2006.01)
*A24F 47/00* (2006.01)

(52) U.S. Cl.
CPC ..... *A24F 47/008* (2013.01)

(58) Field of Classification Search
None
See application file for complete search history.

(56) References Cited

U.S. PATENT DOCUMENTS 8,857,446 B2 * 10/2014 Wu ..... A24F 47/008 128/202.21
9,055,770 B2 * 6/2015 Liu ..... A61M 15/06
9,101,729 B2 * 8/2015 Liu ..... A61M 15/06
9,185,937 B2 * 11/2015 Liu ..... A24F 47/008
9,204,670 B2 * 12/2015 Liu ..... A24F 47/008
9,210,738 B2 * 12/2015 Ward ..... H05B 3/00
2011/0011396 A1 * 1/2011 Fang ..... A24F 47/008 128/202.21
2011/0303231 A1 * 12/2011 Li ..... A24F 47/008 131/329
2014/0314397 A1 * 10/2014 Alima ..... A24F 47/008 392/386
2015/0366267 A1 * 12/2015 Liu ..... H01M 2/1055 131/329
2016/0015081 A1 * 1/2016 Liu ..... H05B 3/16 131/329
2016/0021929 A1 * 1/2016 Sawalha ..... A24F 47/002 131/329
2016/0073692 A1 * 3/2016 Alarcon ..... A24F 47/008 131/329
2016/0095354 A1 * 4/2016 Wu ..... A24F 47/008 131/329

* cited by examiner

*Primary Examiner* — Thor Campbell
(74) *Attorney, Agent, or Firm* — Cheng-Ju Chiang

(57) ABSTRACT

An atomizing device of an electronic cigarette is disclosed. The atomizing device comprises a liquid cup used for accommodating tobacco liquid, an outer tube wrapped outside the liquid cup and a heating atomizing component disposed at a bottom of the liquid cup. A bottom of the heating atomizing component is sealed by a liquid blocking plug. A top of the liquid cup is provided and disposed with a detachable top cover and a detachable sealing plug used to seal the top of the liquid cup. A liquid filling hole and an exhaust hole are respectively disposed and installed at the liquid cup. The atomizing device of an electronic cigarette of the present invention is able to avoid any difficulty of pouring tobacco liquid due to incapability of exhausting air resided in the liquid cup out, and to accelerate a pouring speed of tobacco liquid so that production efficiency is enhanced.

5 Claims, 4 Drawing Sheets

ATOMIZING DEVICE OF ELECTRONIC CIGARETTE

BACKGROUND OF THE INVENTION

1. Field of the Invention

The present invention relates to electronic cigarette technology fields, and especially to an atomizing device of an electronic cigarette.

2. The Related Arts

Electronic cigarettes, also known as virtual cigarettes or electronic atomizers, are mainly used for smoke quitting and substituting actual cigarettes. Electronic cigarettes have a same appearance as and similar taste to actual cigarettes. Some electronic cigarettes even have more tastes than general actual cigarettes. Electronic cigarettes can be used to suck out smoke and flavors therein, and to sense feelings of inhaling and exhaling same as actual cigarettes. In addition, electronic cigarettes have no other harmful ingredients existing in actual cigarettes, such as tar and suspended particles, etc. Hence, electronic cigarettes have become the best alternatives to replace actual cigarettes.

A liquid accommodating space of existing liquid pre-injected atomizing devices of an electronic cigarette generally is designed to adopt liquid storage media. It is time consuming during production of existing atomizing devices since infiltrating smoke liquid into the liquid storage media takes a long time to finish. Usually, the liquid storage media is designed to surround a heating component and an air passage. As a result, it easily leads to misoperation that the smoke liquid is poured into the air passage to result in situations that users directly suck in tobacco liquid from the air passage.

SUMMARY OF THE INVENTION

The main objective of the present invention is to provide an atomizing device of an electronic cigarette which is able to overcome existing problems of slow liquid filling speed and frequent tobacco liquid leakage so that production efficiency is highly enhanced and safety of delivering electronic cigarettes is improved.

To achieve the above mentioned objectives of the present invention, the present invention adopts technology solutions as follows.

An atomizing device of an electronic cigarette comprises a liquid cup used for accommodating tobacco liquid, an outer tube wrapped outside the liquid cup and a heating atomizing component disposed at a bottom of the liquid cup. A bottom of the heating atomizing component is sealed by a liquid blocking plug. A top of the liquid cup is provided and disposed with a detachable top cover and a detachable sealing plug used to seal the top of the liquid cup. A liquid filling hole and an exhaust hole are respectively disposed and installed at the liquid cup. A liquid filling hole plug and an exhaust hole plug are correspondingly disposed at an inner side of the top cover. A vent hole is installed and disposed at a center of the top cover for the sealing plug plugging thereinto. An air passage used for exhausting smoke of the electronic cigarette is formed between a side of the liquid cup and the outer tube.

Furthermore, in the atomizing device of an electronic cigarette as described above, the heating atomizing component comprises a battery, a metal sleeve installed and disposed between the liquid cup and the outer tube, a thread thimble threadedly connected and sealed to the metal sleeve, and an electric heating wire, an insulating holder, a connecting seat and an engaging insert all of which are disposed in and around threaded connection of the metal sleeve and the thread thimble. The electric heating wire is fixed on the insulating holder. The insulating holder is installed and connected on the connecting seat. The engaging insert is disposed at a bottom of the connecting seat and electrically connects to a positive electrode of the electric heating wire. The thread thimble electrically connects to a negative electrode of the electric heating wire. The thread thimble electrically connects to a positive electrode of the battery, and a negative electrode of the battery electrically connects to the engaging insert.

Furthermore, in the atomizing device of an electronic cigarette as described above, a filter net and a filter cotton are disposed between the electric heating wire and the liquid cup. The filter net is disposed at the bottom of the liquid cup. The filter cotton is attached to a bottom of the filter net.

Furthermore, in the atomizing device of an electronic cigarette as described above, an insulating pad is installed between the thread thimble and the engaging insert.

Furthermore, in the atomizing device of an electronic cigarette as described above, the outer tube is a plastic outer tube.

The atomizing device of an electronic cigarette of the present invention is able to avoid any difficulty of pouring tobacco liquid due to incapability of exhausting air resided in the liquid cup out, and to greatly accelerate a pouring speed of tobacco liquid so that production efficiency is highly enhanced and safety of delivering electronic cigarettes is improved.

DETAILED DESCRIPTION OF PREFERRED EMBODIMENT

In order to facilitate understanding of the present invention, the following descriptions accompanying attached drawings are presented to further completely describe the present invention. Attached drawings show a preferred embodiment of the present invention. However, the present invention may be implemented by many different forms thereof and is not limited to the preferred embodiments described herein. On the contrary, the purpose of providing these embodiments is for much more thorough and entire understanding of the published disclosure of the present invention.

Figure 1:
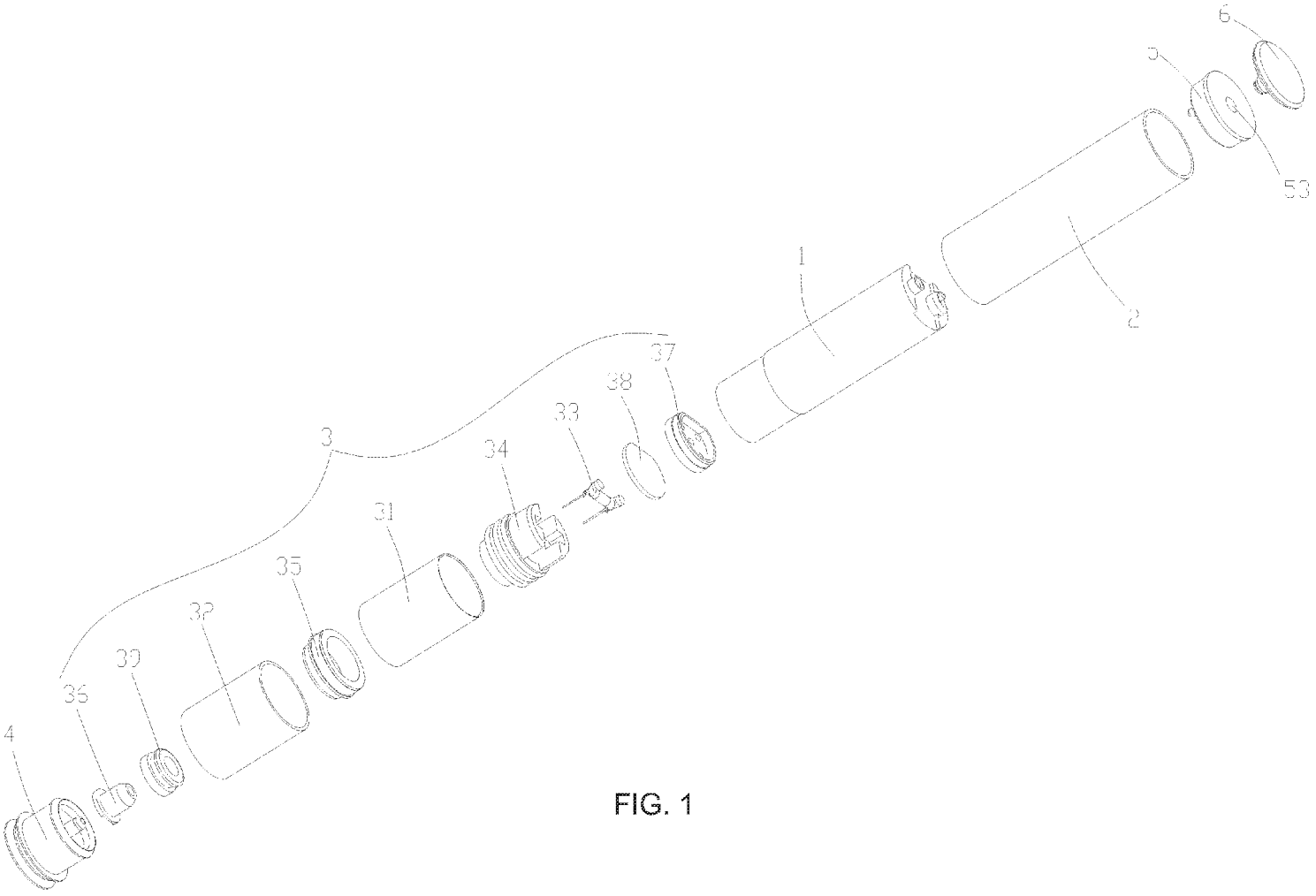
FIG. 1 is a structural schematic exploded perspective view of an atomizing device of an electronic cigarette in accordance with an embodiment of the present invention.
Figure 2:
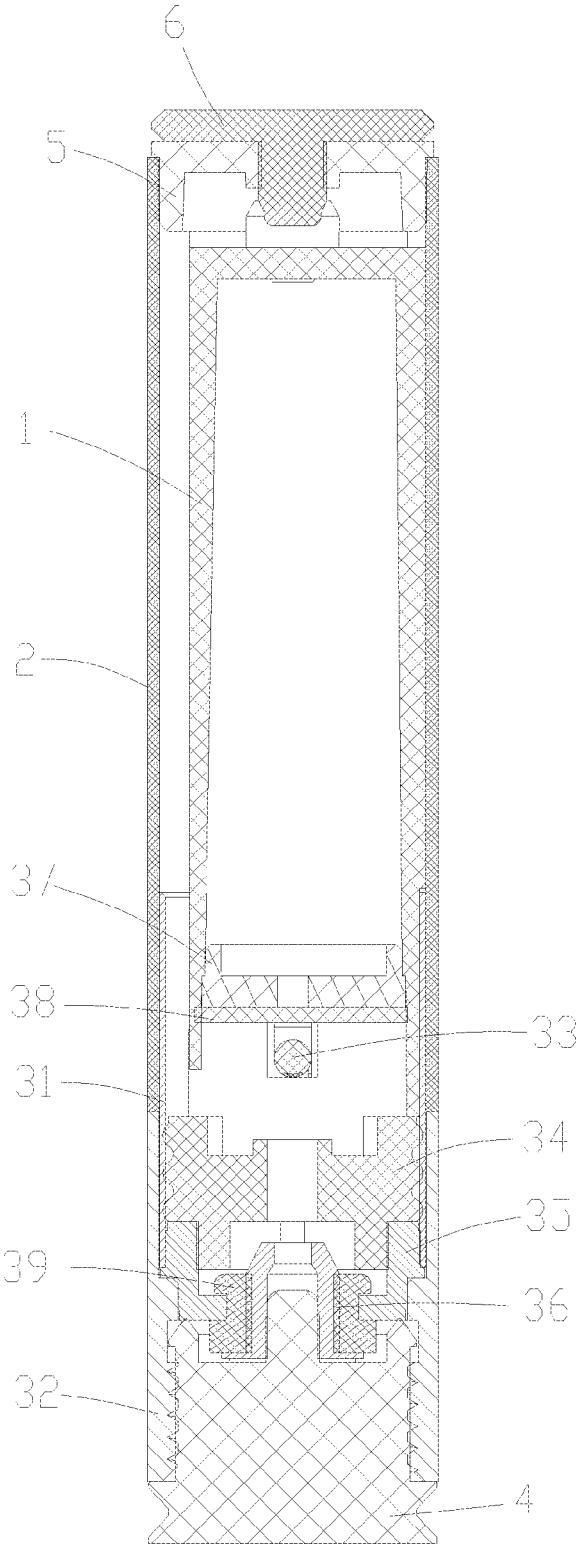
FIG. 2 is a schematic cross sectional view of the atomizing device of an electronic cigarette as shown in FIG. 1 in accordance with the present invention.
Figure 3:
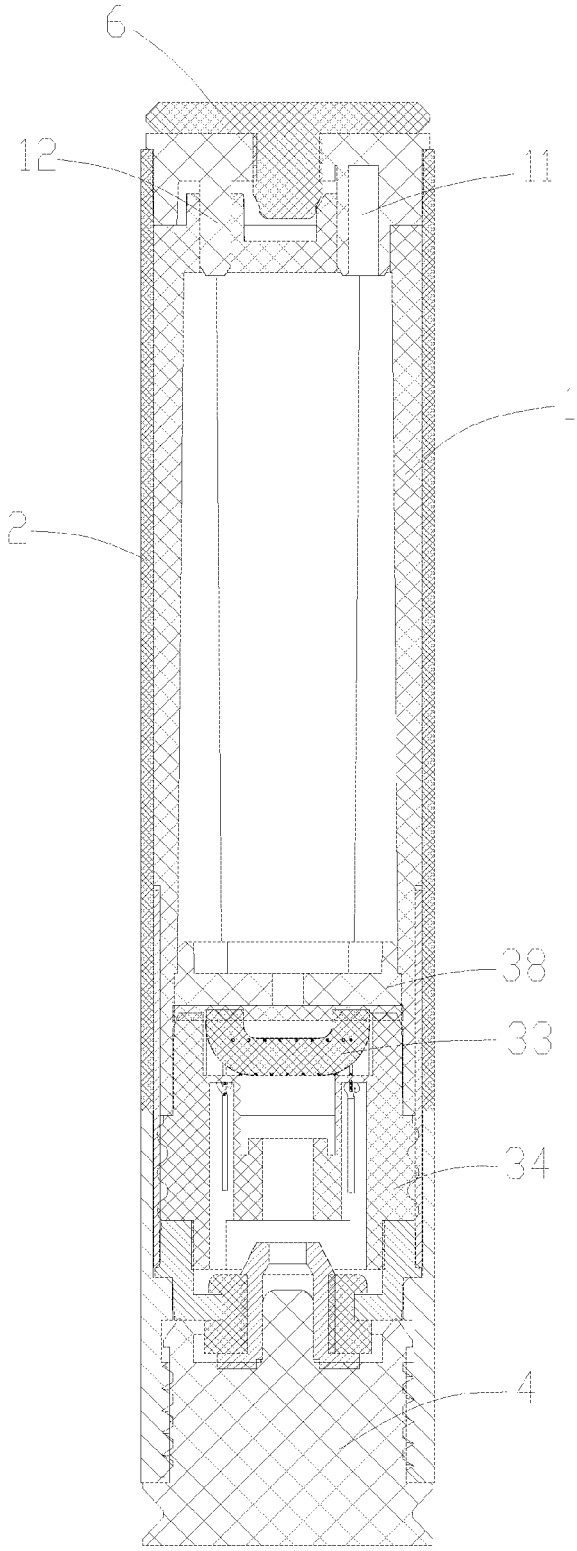
FIG. 3 is a schematic cross sectional view of the atomizing device of an electronic cigarette as shown in FIG. 1 viewing from another viewing angle in accordance with the present invention.
Figure 4:
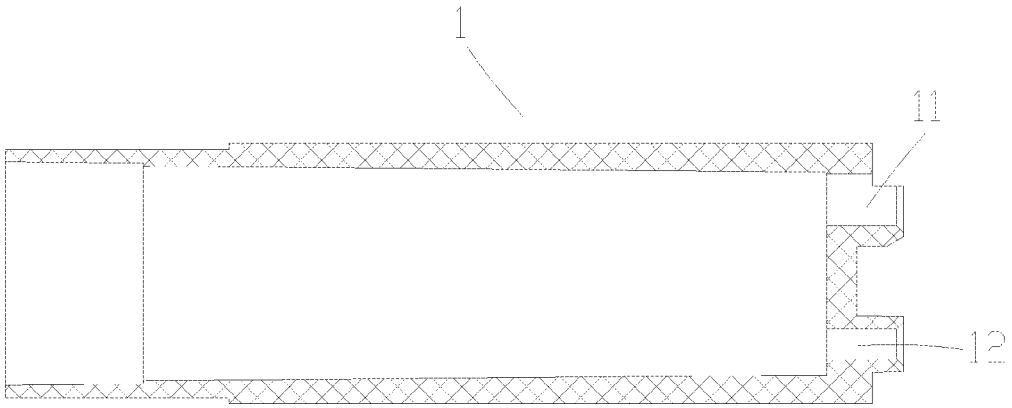
FIG. 4 is a structural schematic cross sectional view of a liquid cup shown in FIG. 1.
Figure 5:
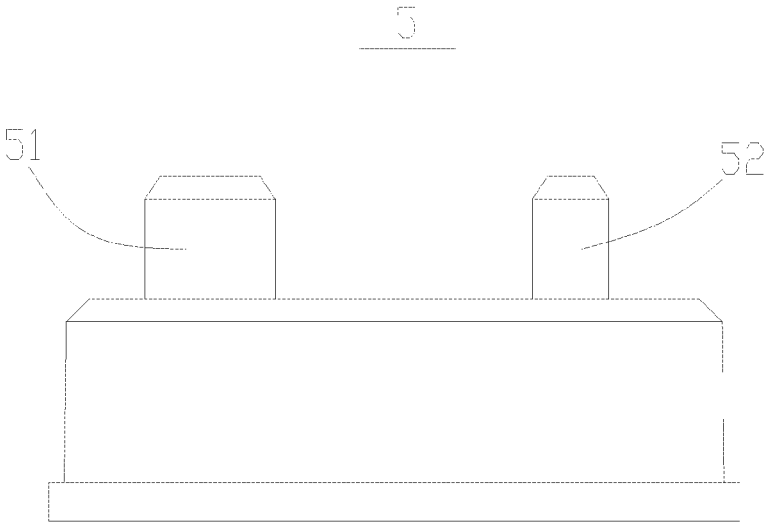
FIG. 5 is a structural schematic side view of a top cover shown in FIG. 1.

Referring to FIGS. 1 to 5, an atomizing device of an electronic cigarette comprises a liquid cup 1 used for accommodating tobacco liquid, an outer tube 2 wrapped outside the liquid cup 1 and a heating atomizing component 3 disposed at a bottom of the liquid cup 1. The bottom of the heating atomizing component 3 is sealed by a liquid blocking plug 4. A top of the liquid cup 1 is provided and disposed with a detachable top cover 5 and a detachable sealing plug 6 so as to seal the top of the liquid cup 1. A liquid filling hole 11 and an exhaust hole 12 are respectively disposed and installed at the liquid cup 1. A liquid filling hole plug 51 and an exhaust hole plug 52 are correspondingly disposed at an inner side the top cover 5.

Herein, a vent hole 53 is installed and disposed at a center of the top cover 5 for the sealing plug 6 plugging therein so as to seal the vent hole 53.

The heating atomizing component 3 comprises a battery (not shown), a metal sleeve 31 installed and disposed between the liquid cup 1 and the outer tube 2, a thread thimble 32 threadedly connected and sealed to the metal sleeve 31, and an electric heating wire 33, an insulating holder 34, a connecting seat 35 and an engaging insert 36 all of which are disposed in and around threaded connection of the metal sleeve 31 and the thread thimble 32. The electric heating wire 33 is fixed on the insulating holder 34. The insulating holder 34 is installed and connected on the connecting seat 35. The engaging insert 36 is disposed at a bottom of the connecting seat 35 and electrically connects to a positive electrode of the electric heating wire 33. The thread thimble 32 electrically connects to a negative electrode of the electric heating wire 33. The thread thimble 32 electrically connects to a positive electrode of the battery, and a negative electrode of the battery electrically connects to the engaging insert 36.

A filter net 37 and a filter cotton 38 are disposed between the electric heating wire 33 and the liquid cup 1. The filter net 37 is disposed at the bottom of the liquid cup 1. The filter cotton 38 is attached to a bottom of the filter net 37. The thread thimble 32 and the engaging insert 36 engage with the battery of the electronic cigarette to electrically conduct therewith. Then, the electric heating wire 33 heats tobacco liquid moving down from the liquid cup 1 and filtered by the filter net 37 and the filter cotton 38 while the tobacco liquid passes therethrough so as to generate smoke.

An insulating pad 39 is installed between the thread thimble 32 and the engaging insert 36. The insulating pad 39 is made of insulation materials. The outer tube 2 is a plastic outer tube.

Manufacturing processes and working processes of the atomizing device of an electronic cigarette of the present invention are described as follows.

In manufacturing, at first, tobacco liquid is poured into the liquid cup 1 through the liquid filling hole 11. A U-shaped air passage is formed by the exhaust hole 12 and the liquid filling hole 11. Hence, air resided in the liquid cup 1 can be exhausted smoothly from the exhaust hole 12 when pouring tobacco liquid so as to avoid any difficulty of pouring tobacco liquid due to incapability of exhausting the air resided in the liquid cup 1 out. Subsequently, the top cover 5 is covered on the top of the liquid cup 1 so that the liquid filling hole plug 51 and the exhaust hole plug 52 are respectively tightly inserted into the liquid filling hole 11 and the exhaust hole 12. Then, the sealing plug 6 is inserted into the vent hole 53 of the top cover 5 for sealing. Finally, the bottom of the heating atomizing component 3 is sealed by the liquid blocking plug 4. Hereafter, electronic cigarette products can be delivered after manufacturing and packaging.

In use, the sealing plug 6 is firstly pulled out from the vent hole 53 of the top cover 5, and the liquid blocking plug 4 is pulled out from the bottom of the heating atomizing component 3. Then the electric heating wire 33 is engaged to be electrically conducted for heating tobacco liquid moving down from the liquid cup 1 and filtered by the filter net 37 and the filter cotton 38 while the tobacco liquid passes therethrough so as to generate smoke. An air passage used for exhausting smoke of the electronic cigarette is formed between a side of the liquid cup 1 and the outer tube 2. Air enters the insulating holder 34 through the engaging insert 36. Smoke atomized by the heating atomizing component 3 accompanying the entering air passes through the air passage mentioned above and then is exhausted from the vent hole 53 of the top cover 5.

Compared with existing technology, the atomizing device of an electronic cigarette of the present invention utilizes the liquid cup 1 to accommodate tobacco liquid so as to greatly accelerate a filling speed of tobacco liquid. Designs of the atomizing device of an electronic cigarette of the present invention overcome slow liquid filling speed of the existing technology, and help to enhance production efficiency and to facilitate high efficient production of a large number of products. Moreover, the atomizing device of an electronic cigarette of the present invention comprises a design of the exhaust hole 12 of the liquid cup 1 to avoid any difficulty of pouring tobacco liquid due to incapability of exhausting air resided in the liquid cup 1 out. In addition, the atomizing device of an electronic cigarette of the present invention comprises a design of seal components for assuring the atomizing device is in a seal state after tobacco liquid is poured therein and for avoiding problem of tobacco liquid leakage so as to improve safety performance of using electronic cigarettes.

In sum, the atomizing device of an electronic cigarette of the present invention is able to avoid any difficulty of pouring tobacco liquid due to incapability of exhausting air resided in the liquid cup 1 out, and to greatly accelerate a pouring speed of tobacco liquid so that production efficiency is highly enhanced and safety of delivering electronic cigarettes is improved.

Descriptions and applications of the present invention herein are intended to be illustrative, not intended to limit the scope of the present invention to the above described embodiment. Variations and modifications of the embodiment disclosed herein are possible, and for those of ordinary skilled in the field, alternatives and equivalents of various components of the embodiment disclosed herein are common senses and well known. Where any person skilled in this art should know that the present invention can be achieved in other forms, structures, arrangements, proportions, and with other components, materials, and parts, the changes or improvements are still covered within the inventive spirit of the present invention and the scope as defined in the following claims. Without departing from the spirit and scope of the present invention, other modifications and changes of the embodiment disclosed herein can be made and still be covered by the claimed scope of the following claims.

What is claimed is:

1. An atomizing device of an electronic cigarette, comprising a liquid cup used for accommodating tobacco liquid, an outer tube wrapped outside the liquid cup and a heating atomizing component disposed at a bottom of the liquid cup, a bottom of the heating atomizing component sealed by a liquid blocking plug, a top of the liquid cup provided and disposed with a detachable top cover and a detachable sealing plug used to seal the top of the liquid cup, a liquid filling hole and an exhaust hole respectively disposed and installed at the liquid cup, a liquid filling hole plug and an exhaust hole plug correspondingly disposed at an inner side of the top cover, a vent hole installed and disposed at a center of the top cover for the sealing plug plugging thereinto, an air passage used for exhausting smoke of the electronic cigarette formed between a side of the liquid cup and the outer tube.

2. The atomizing device of an electronic cigarette as claimed in claim 1, wherein the heating atomizing component comprises a battery, a metal sleeve installed and disposed between the liquid cup and the outer tube, a thread thimble threadedly connected and sealed to the metal sleeve, and an electric heating wire, an insulating holder, a connecting seat and an engaging insert all of which are disposed in and around threaded connection of the metal sleeve and the thread thimble, the electric heating wire is fixed on the insulating holder, the insulating holder is installed and connected on the connecting seat, the engaging insert is disposed at a bottom of the connecting seat and electrically connecting to a positive electrode of the electric heating wire, the thread thimble electrically connects to a negative electrode of the electric heating wire, the thread thimble electrically connects to a positive electrode of the battery, and the engaging insert electrically connects to a negative electrode of the battery.

3. The atomizing device of an electronic cigarette as claimed in claim 2, wherein a filter net and a filter cotton are disposed between the electric heating wire and the liquid cup, the filter net is disposed at the bottom of the liquid cup, the filter cotton is attached to a bottom of the filter net.

4. The atomizing device of an electronic cigarette as claimed in claim 3, wherein an insulating pad is installed between the thread thimble and the engaging insert.

5. The atomizing device of an electronic cigarette as claimed in claim 1, wherein the outer tube is a plastic outer tube.

* * * * *